United States Patent [19]

Pryba et al.

[11] Patent Number: 5,063,889

[45] Date of Patent: Nov. 12, 1991

[54] ROCKER ARM WITH LUBRICATION PROVISIONS

[75] Inventors: Stanley J. Pryba; Jesse V. Mills, both of Toledo; Sherkoh A. Abbas, Maumee, all of Ohio

[73] Assignee: Henley Manufacturing Holding Company, Inc., Hampton, N.H.

[21] Appl. No.: 571,790

[22] Filed: Aug. 24, 1990

[51] Int. Cl.[5] ..... F01L 1/18

[52] U.S. Cl. ..... 123/90.39; 123/90.41; 123/90.33

[58] Field of Search ..... 123/90.36, 90.34, 90.33, 123/90.4, 90.41, 90.42, 90.44, 90.45, 90.47; 74/519, 559

[56] References Cited

U.S. PATENT DOCUMENTS

| | | | |
|---|---|---|---|
| 2,811,959 | 11/1957 | Etchells | 123/90.33 |
| 2,905,161 | 9/1959 | Latham | 123/90.39 |
| 3,082,755 | 3/1963 | Gropp | 74/559 |
| 3,289,657 | 12/1966 | Winter, Jr. | 123/90.33 |
| 4,614,171 | 9/1986 | Malhotra | 123/90.36 |
| 4,624,223 | 11/1986 | Wherry et al. | 123/90.44 |
| 4,697,473 | 10/1987 | Patel | 123/90.44 |
| 4,784,095 | 11/1988 | Golding et al. | 123/90.41 |
| 4,872,429 | 10/1989 | Anderson et al. | 123/90.44 |
| 4,944,257 | 7/1990 | Mills | 123/90.39 |

*Primary Examiner*—E. Rollins Cross
*Assistant Examiner*—Weilun Lo
*Attorney, Agent, or Firm*—Allen D. Gutchess, Jr.

[57] ABSTRACT

A cold-formed rocker arm with unique lubrication provisions is disclosed. The rocker arm includes a one-piece metal body of generally inverted U-shaped cross section having a top wall and two side walls. One end of the body has a recess to engage an end of a push rod and the other end has a large, upwardly-facing recess to retain oil so as to provide lubrication substantially immediately when the engine is started. The bottom surface of the reservoir forms a pad to engage an end of a valve stem. A mounting bolt of the rocker arm has a splash ring on the head thereof to disperse oil when intercepting a stream thereof.

10 Claims, 2 Drawing Sheets

ROCKER ARM WITH LUBRICATION PROVISIONS

This invention relates to a cold-formed rocker arm having a large upper oil reservoir and a mounting bolt with a splash ring.

The rocker arm in accordance with the invention includes a one-piece metal body which is of inverted U-shaped cross section throughout most of its length. The body has a top wall with two structurally-integral side walls depending therefrom. One end portion of the rocker arm body has a recess formed therein and facing downwardly to receive an upper end of a push rod and has a slanted oil port directed upwardly toward an intermediate portion of the rocker arm. A second end portion of the rocker arm body has a large upwardly-facing recess in the top wall forming a large oil reservoir to retain oil when the engine is stopped. An oil passage is formed therein, communicating with a lower surface of the top wall below the reservoir, which surface is convex facing downwardly, and forms a pad to engage an upper end of a valve stem.

The rocker arm body has aligned annular flanges in the side walls thereof to receive bearings which are mounted on ends of a hub located between the side walls of the rocker arm. The hub has a transverse bore through which a mounting bolt extends to support the rocker arm on a cylinder head of an internal combustion engine. The mounting bolt has a head which extends upwardly through an intermediate opening in the top wall of the rocker arm and the head has an outwardly-extending splash ring therearound. The splash ring is positioned to intercept a stream of lubricant from the slanted oil port and disperse it, with some being received in the large oil reservoir.

It is, therefore, a principal object of the invention to provide a rocker arm with lubricant provisions which supply lubricant to portions of the rocker arm when an internal combustion engine is started.

Another object of the invention is to provide a rocker arm having a large oil reservoir in an upper surface thereof.

Yet another object of the invention is to provide a rocker arm of the cold-formed type having an oil reservoir in an end portion thereof with a downwardly-facing convex surface forming a pad to engage a valve stem.

Yet a further object of the invention is to provide a rocker arm having a mounting bolt with a splash ring thereon positioned to intercept and disperse a stream of oil.

Still a further object of the invention is to provide a rocker arm with a large oil reservoir to provide lubrication at start up and a mounting bolt with a splash ring to supply oil to the reservoir.

Many other objects and advantages of the invention will be apparent from the following detailed description of a preferred embodiment thereof, reference being made to the accompanying drawings, in which.

Figure 1:
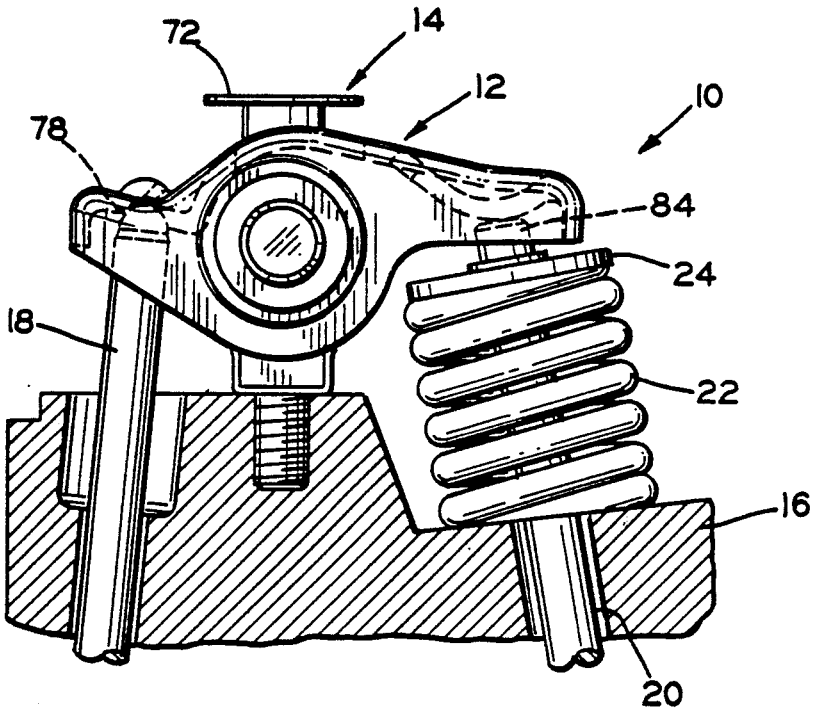
FIG. 1 is a fragmentary, somewhat schematic side view in elevation of a rocker arm assembly in accordance with the invention, mounted on an engine which is shown in cross section.

Referring to the drawings, and particularly to FIG. 1, a rocker arm assembly in accordance with the invention is indicated at 10 and includes a cold-formed rocker arm 12 pivotally mounted on a supporting pedestal 14. The supporting pedestal is affixed to a cylinder head 16 of an engine block. One end of the rocker arm 12 engages a push rod 18 through which oil is supplied, and the other end of the rocker arm engages a valve stem 20. The valve stem extends upwardly from a valve (not shown) in the cylinder head and through a coiled compression spring 22 which is between the cylinder head and a retaining ring 24 mounted on the valve stem.

Figure 4:
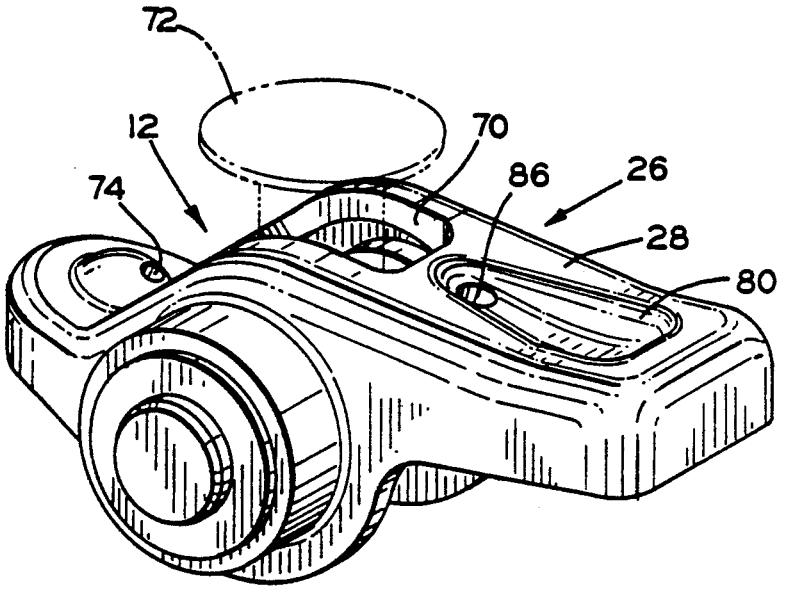
FIG. 4 is a view in perspective of the rocker arm, with a mounting bolt shown in dotted lines.
Figure 2:
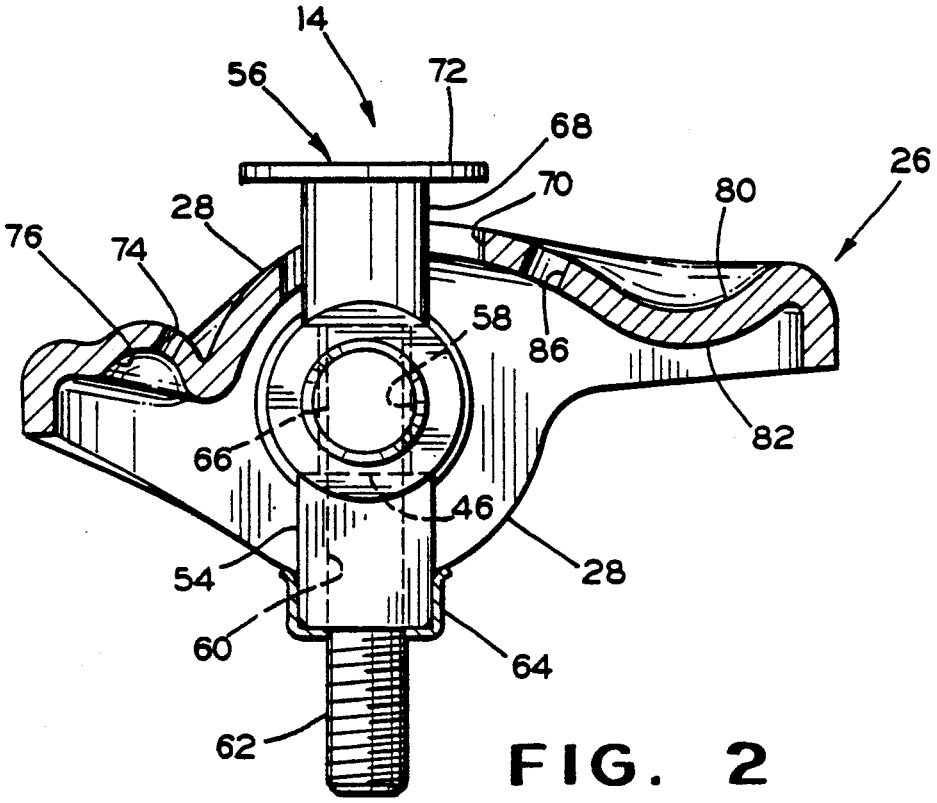
FIG. 2 is an enlarged view in longitudinal cross section of the rocker arm shown in FIG. 1.
Figure 3:
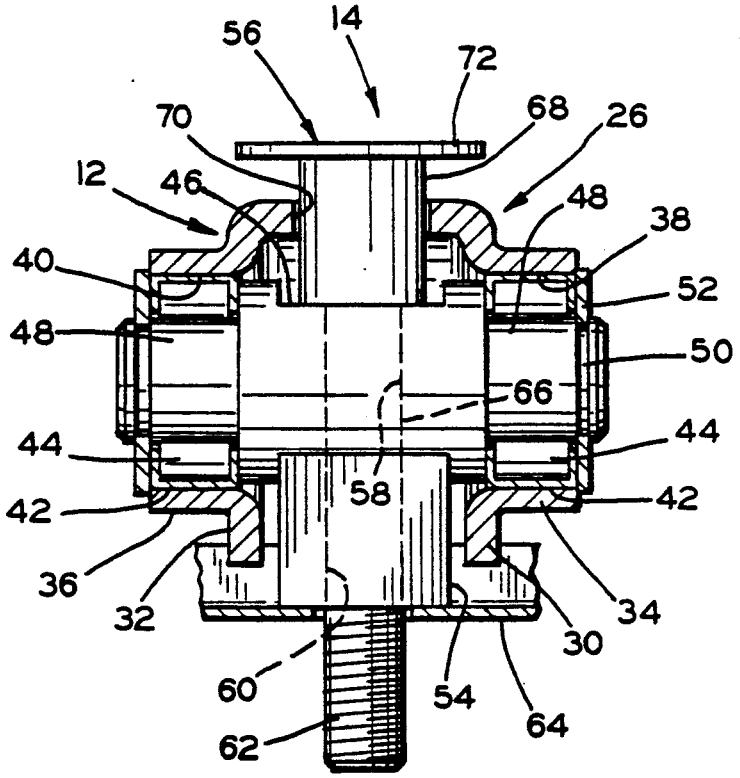
FIG. 3 is a view in transverse cross section taken through a central portion of the rocker arm of FIG. 2.

Referring more particularly to FIGS. 2–4, the rocker arm 12 includes a one-piece metal body 26 having a top wall 28 and two structurally-integral side walls 30 and 32 depending therefrom. Central portions of the side walls 30 and 32 have annular flanges 34 and 36 extending outwardly therefrom and being structurally integral therewith. These flanges are stamped or extruded from the side walls 30 and 32 and form aligned bores 38 and 40 (FIG. 3). Outer bearing races 42 are press fit in the bores and retain rolling elements or needles 44. The mounting pedestal 14 has a hub 46 from which cylindrical extensions 48 extend, forming inner races for the bearing elements. Ends of the extensions 48 have annular grooves 50 which hold suitable snap rings 52 which restrict axially movement of the outer races 42. A mounting post 54 fits closely with a lower surface of the hub 46 and supports the rocker arm assembly above the upper surface of the cylindrical head 16. The hub 46 and the post 54 are held in assembled relationship by a mounting bolt 56 which extends through bores 58 and 60 in the hub 46 and the mounting post 54. A lower threaded end 62 of the bolt 56 extends through a trough element 64 which cooperates with the mounting post 54 to aid in retaining the rocker arm assembly 10 in position. The mounting bolt 56 further includes an intermediate shank 66 which extends through the bores 58 and 60 and an enlarged head 68 which extends through an elongate, generally rectangular intermediate opening 70 in an intermediate portion of the top wall 28 of the rocker arm body 26. The upper end of the enlarged head 68 of the mounting bolt 56 above the top wall 28 has an outwardly-extending splash ring 72 thereon in accordance with the invention.

The splash ring 72 is positioned to receive a stream of oil issuing from a slanted oil port 74 at one end of the rocker arm body 26. The supply port 74 extends through the top wall 28 and communicates with a downwardly-facing recess 76 which is of generally semi-spherical shape and engages a rounded upper end 78 (FIG. 1) of the push rod 18. Oil supplied through the push rod 18 is directed by the port 74 toward the splash ring 72 and is intercepted and dispersed by the splash ring.

A portion of the oil dispersed by the splash ring is received in a large oil reservoir 80 which is formed at an end portion of the top wall 28 opposite the recess 76. The reservoir 80 is formed by an upwardly-facing recess stamped in the top wall 28 which also forms a downwardly-facing convex surface or pad 82 on the underside of the top wall 28. The pad 82 engages an upper end 84 (FIG. 1) of the valve stem 20. One stamping operation thus forms both the large oil reservoir 80 and the valve stem pad 82. An oil passage 86 (FIGS. 2 and 4) extends through the top wall 28 to supply oil from the reservoir 80 to the pad 82 almost immediately when the engine is started to minimize wear of the components. The oil passage 86 is located near an upper shallow end portion of the reservoir 80 so that oil will be retained in the reservoir 80 regardless of the position of the rocker arm 12 when the engine is stopped. Further, the reservoir 80 is wide toward the end of the rocker arm body 26 to provide greater oil capacity. The reservoir is also narrower toward the oil passage 86 to more effectively direct oil into the passage 86. The reservoir 80 is large enough to supply oil to the pad 82 for about fifteen to twenty seconds when the engine is first started.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. A cold-formed rocker arm comprising a onepiece metal body of generally inverted U-shaped cross section throughout most of its length, said body having a top wall and two side walls extending downwardly therefrom and being integral therewith, said side walls having annular flanges extending outwardly therefrom and forming aligned bores to receive bearings, said body having means at one end to engage an end of a push rod, and said body having an upwardly-facing recess in the top wall at the other end thereof, the bottom surface of said top wall below said recess forming a pad to engage an end of a valve stem, said recess having a shallow portion and a deeper portion, said deeper portion being closer to said other end than said shallow portion, said top wall having a lubrication passage extending therethrough communicating with said shallow portion of said recess and with said pad, with oil being retained at least in said deeper portion for any position the rocker arm is in when the engine is stopped.

2. A cold-formed rocker arm according to claim 1 wherein said rocker arm has a mounting hub with bearings at the ends thereof located in said annular flanges, said mounting hub having a central bore therethrough, said top wall having an intermediate opening therein, and a mounting bolt extending through said intermediate opening and through said bore in said mounting hub to pivotally mount said rocker arm on a cylinder head of an internal combustion engine.

3. A cold-formed rocker arm according to claim 2 wherein said bolt has an annular flange extending outwardly therefrom above said top wall of said rocker arm to provide a lubrication splash plate for said rocker arm.

4. A cold-formed rocker arm according to claim 3 wherein said means to engage an end of a push rod has an oil port extending through said top wall and aligned with said splash plate to direct oil toward said splash plate.

5. A cold-formed rocker arm for an internal combustion engine, said rocker arm comprising a one-piece metal body of generally inverted U-shaped cross section throughout most of its length, said body having a top wall and two side walls extending downwardly therefrom, said body having means at one end portion to engage an end of a push rod, said body having means at the other end portion to engage an end of a valve stem, said body having an upwardly-facing recess at said other end portion to provide an oil reservoir for supplying oil to said last-named means when the engine is started, and said body having a lubrication passage communicating with said means to engage the end of the valve stem and with said recess, said recess having a shallow portion and a deeper portion, said passage communicating with the shallow portion of said recess, the deeper portion of said recess retaining oil therein for any position of the rocker arm.

6. A cold-formed rocker arm according to claim 5 wherein said rocker arm has a mounting hub located between said side walls of said body, said mounting hub having a central bore therethrough, and a mounting bolt extending through said bore and above said top wall, said bolt having a splash plate extending outwardly therefrom above said top wall.

7. A cold-formed rocker arm according to claim 6 wherein said body has an oil port therein for directing oil toward said splash plate.

8. A cold-formed rocker arm according to claim 7 wherein said means for engaging the upper end of the push rod is a downwardly-facing recess and said oil port communicates with said downwardly-facing recess.

9. A cold-formed rocker arm comprising a onepiece metal body of generally inverted U-shaped cross section throughout most of its length, said body having a top wall and two side walls extending downwardly therefrom and being structurally integral therewith, said body having means at one end portion to engage an end of a push rod, said body having an upwardly-facing recess in an upper surface of the top wall toward the other end of said body, said body forming a downwardly-facing pad on a lower surface of the top wall to engage an end of a valve stem, said top wall being of substantially uniform thickness between said upper and lower surfaces forming said recess and said pad, said body having a lubrication passage communicating with said pad and with said recess, said top wall having an intermediate opening therein, a mounting hub between intermediate portions of said side walls of said body, said mounting hub having a central bore therethrough, and a mounting bolt extending through said central bore and through said intermediate opening, said bolt having a splash place above said top wall of said body.

10. A cold-formed rocker arm according to claim 9 wherein said recess has a shallow portion and a deeper portion and said passage communicates with the shallow portion of said recess.

* * * * *